US007137430B2

(12) United States Patent
Fraczek

(10) Patent No.: US 7,137,430 B2
(45) Date of Patent: Nov. 21, 2006

(54) MONO CONTROL LIFT AND TILT MECHANISM FOR HORIZONTAL BLINDS

(75) Inventor: Richard Fraczek, Stamford, CT (US)

(73) Assignee: Rollease, Inc., Stamford, CT (US)

( * ) Notice: Subject to any disclaimer, the term of this patent is extended or adjusted under 35 U.S.C. 154(b) by 580 days.

(21) Appl. No.: 10/389,837

(22) Filed: Mar. 17, 2003

(65) Prior Publication Data

US 2003/0178155 A1 Sep. 25, 2003

Related U.S. Application Data

(60) Provisional application No. 60/367,308, filed on Mar. 25, 2002.

(51) Int. Cl.
*E06B 9/30* (2006.01)

(52) U.S. Cl. ..... 160/170

(58) Field of Classification Search ..... 160/170 R, 160/171 R, 173 R, 176.1 R, 177 R, 319, 160/321, 168.1 R, 170, 171
See application file for complete search history.

(56) References Cited

U.S. PATENT DOCUMENTS

| | | | | |
|---|---|---|---|---|
| 13,429 | A | 8/1855 | Gesner | |
| 23,499 | A | 4/1859 | Reed | |
| 1,888,193 | A | 11/1932 | Bartell | |
| 1,933,755 | A | 11/1933 | Poulsen | |
| 2,237,371 | A | 4/1941 | Simons | |
| 2,264,555 | A | 12/1941 | Rogers | |
| 2,353,576 | A | 7/1944 | Mcilvried | |
| 2,620,995 | A | 12/1952 | Larcinese | |
| 2,737,235 | A * | 3/1956 | Hediger | 160/170 R |
| 2,758,644 | A * | 8/1956 | Virlouvet | 160/170 R |
| 2,930,539 | A | 3/1960 | Bremer | |
| 3,225,446 | A | 12/1965 | Sarfati | |
| 3,402,589 | A | 9/1968 | Lathom | |
| 3,664,205 | A | 5/1972 | Luras | |
| 3,968,953 | A | 7/1976 | Guangorena | |
| 4,164,859 | A | 8/1979 | Steinhilber | |
| 4,200,135 | A * | 4/1980 | Hennequin | 190/176.1 R |
| 4,252,010 | A | 2/1981 | Rossi | |
| 4,252,298 | A | 2/1981 | Fitch | |
| 4,293,103 | A | 10/1981 | Tsukamoto | |
| D271,150 | S | 10/1983 | Cavanagh | |
| 4,575,050 | A | 3/1986 | Bechmann | |
| 4,604,883 | A | 8/1986 | Schaetzke et al. | |
| 4,697,630 | A | 10/1987 | Rude | |
| 4,819,912 | A | 4/1989 | Plummer | |
| 5,123,472 | A * | 6/1992 | Nagashima et al. | 160/170 R |
| 5,136,866 | A | 8/1992 | Lisciani | |
| 5,228,491 | A | 7/1993 | Rude et al. | |
| 5,328,113 | A | 7/1994 | de Chevron Villette et al. | |
| 5,622,074 | A | 4/1997 | Cushman | |
| 5,628,356 | A | 5/1997 | Marocco | |

(Continued)

*Primary Examiner*—David Purol
(74) *Attorney, Agent, or Firm*—Gottlieb, Rackman & Reisman

(57) ABSTRACT

The invention includes apparatus for controlling the lift and tilt of a horizontal window blind. A tilting drum, conic cord-gathering shaft, torsion spring and support cradle may be combined to provide lift and tilt adjustment with a single rotational control. An angular surface near one end of the cord-gathering shaft deflects winding coils of a lifting cord down the length of the cone. The torsion spring and spring stops in the device allow tilt adjustment to take place in conjunction with the rotation of the cord-gathering shaft. The preferred embodiment includes a cord cover to guide the coils as the diameter of the cord-gathering shaft decreases.

26 Claims, 12 Drawing Sheets

U.S. PATENT DOCUMENTS

| | | | | |
|---|---|---|---|---|
| 5,725,040 | A | 3/1998 | Domel | |
| 5,908,062 | A | 6/1999 | Fun | |
| 6,116,323 | A | 9/2000 | Huang | |
| 6,129,131 | A | 10/2000 | Colson | |
| 6,158,494 | A | 12/2000 | Huang | |
| 6,223,802 | B1 | 5/2001 | Colson | |
| 6,325,131 | B1 * | 12/2001 | Dekker et al. | 160/170 R |
| 6,578,823 | B1 | 6/2003 | Johnson | |
| 6,588,480 | B1 | 7/2003 | Anderson | |
| 6,619,365 | B1 | 9/2003 | Wen et al. | |

* cited by examiner

MONO CONTROL LIFT AND TILT MECHANISM FOR HORIZONTAL BLINDS

This application claims the priority date of U.S. provisional patent application Ser. No. 60/367,308 filed on Mar. 25, 2002.

FIELD OF THE INVENTION

The invention relates to the field of window blinds. More specifically, the invention is a mechanism for a horizontal window blind for controlling the lift of the blind slats as well as the tilt of the blind slats.

BACKGROUND OF THE INVENTION

In the construction of horizontal blinds, particularly in wood blinds, two kinds of controls are desired. The blind should have a control to lift the slats of the blind. In addition, the blind should permit control over the tilt of the slats. Traditionally, two separate operating mechanisms were used to provide the desired control. One device would exclusively control the lifting of the blind while another independent device would control the tilt position of the slats. A single mechanism controlling both functions is preferred.

There are a limited number of prior art mono-controlled lifting and tilting mechanisms. One such system is disclosed in Rude et al. U.S. Pat. No. 5, 228,491. In this device, the tilting function is controlled by the position of flexible plastic arms that may be adjusted by rotation of a shaft on which the tilters are centered. A frictional relationship between the tilter and the shaft allows the flexible tilter to rotate with the shaft rotation in either direction until stopped at limit positions. However, the complex structure of the tilter, which itself provides the varying frictional force on the shaft as a function of the weight of the slats of the blind, limits the application of the device. The structure is difficult to manufacture and may not be appropriate for heavier blinds because the weight makes tilting more difficult. Moreover, when winding the lifting cord, unnecessary transverse movement in addition to rotation is utilized to manage the coils of the lifting cord.

Another such system is disclosed by Marocco, U.S. Pat. No. 5,628,356. This system makes use of tape as the lifting medium. A winding reel collects the tape when the blind is lifted. However, the system does not provide a workable solution for managing a lifting cord. Moreover, tape lift systems are not practical for lifting some blinds such as large wood blinds. Inner holes in the wood have inherently very sharp edges that cause cutting of the tape and will lead to lift failure.

One other known mechanism relies on the constant rotation of the shaft to achieve a tilt. In this invention, the two sides of the ladder cord are joined together in a loop and placed in a V-groove of the tilting mechanism. Constant rotation of the mechanism drags the cord along and creates a tilt. At the same time the lift cord, which is attached to the rotating shaft portion of that mechanism, gathers on the shaft. However, tilting horizontal slats with a V-groove device was never a preferred way of achieving a tilt. The positioning of the slats cannot be accurately controlled. Sometimes, especially on lightweight blinds, the device is not reliable because almost the entire weight of the blind in being supported by the lift cord. This leaves the ladder cord with out much tension in the V-groove and can lead to tilt failure.

BRIEF DESCRIPTION OF THE INVENTION

An objective of the invention is to provide an apparatus that can serve to lift and tilt the slats of window blind with a single user control.

A further objective is to provide such a device that functions with a lifting cord without transverse motion of a winding drum.

A still further objective is to provide such a device that is economical and simple to manufacture.

Additional objectives will be apparent to those skilled in the art upon reading the disclosure of the invention that follows.

The invention is an apparatus to control the lift and tilt of slats of a horizontal blind. The means for lifting includes a cord-gathering shaft which preferably is a truncated cone fixed to a lifting cord to facilitate coiling of the lifting cord when rotated. A deflecting surface positioned around one end of the shaft directs coiling of the lifting cord onto the surface of the cone and in turn moves previously wound coils across its surface towards the opposite end. With a conic surface or cone that gradually and continuously reduces in diameter, coils furthest from the deflecting surface wrap loosely while coils nearer to the deflecting surface wind tightly. The preferred embodiment of the deflecting surface is an angular one such that the coils wind at an angle less than 90 degrees relative to the central rotational axis of the cord-gathering shaft. A cover for the shaft provides a guide for the coils moving along the shaft.

The apparatus also preferably includes a means for tilting the slats that works in conjunction with part of the rotation of the cord-gathering shaft. A tilting drum fixed to a ladder cord raises and lowers alternate sides of the ladder cord when a drum key on the tilting drum is forced to move by the rotation of a torsion spring frictionally wrapped on an axle portion of the cord-gathering shaft. The drum key is positioned between the moving ends of a torsion spring. The axle rests in a support with a brace to prevent longitudinal movement of the axle portion but permit rotation. A means for limiting the rotation of the torsion spring on the support limits the arc of the tilt of the slats by reducing the frictional hold of the torsion spring on the axle.

DETAILED DESCRIPTION

Figure 1:
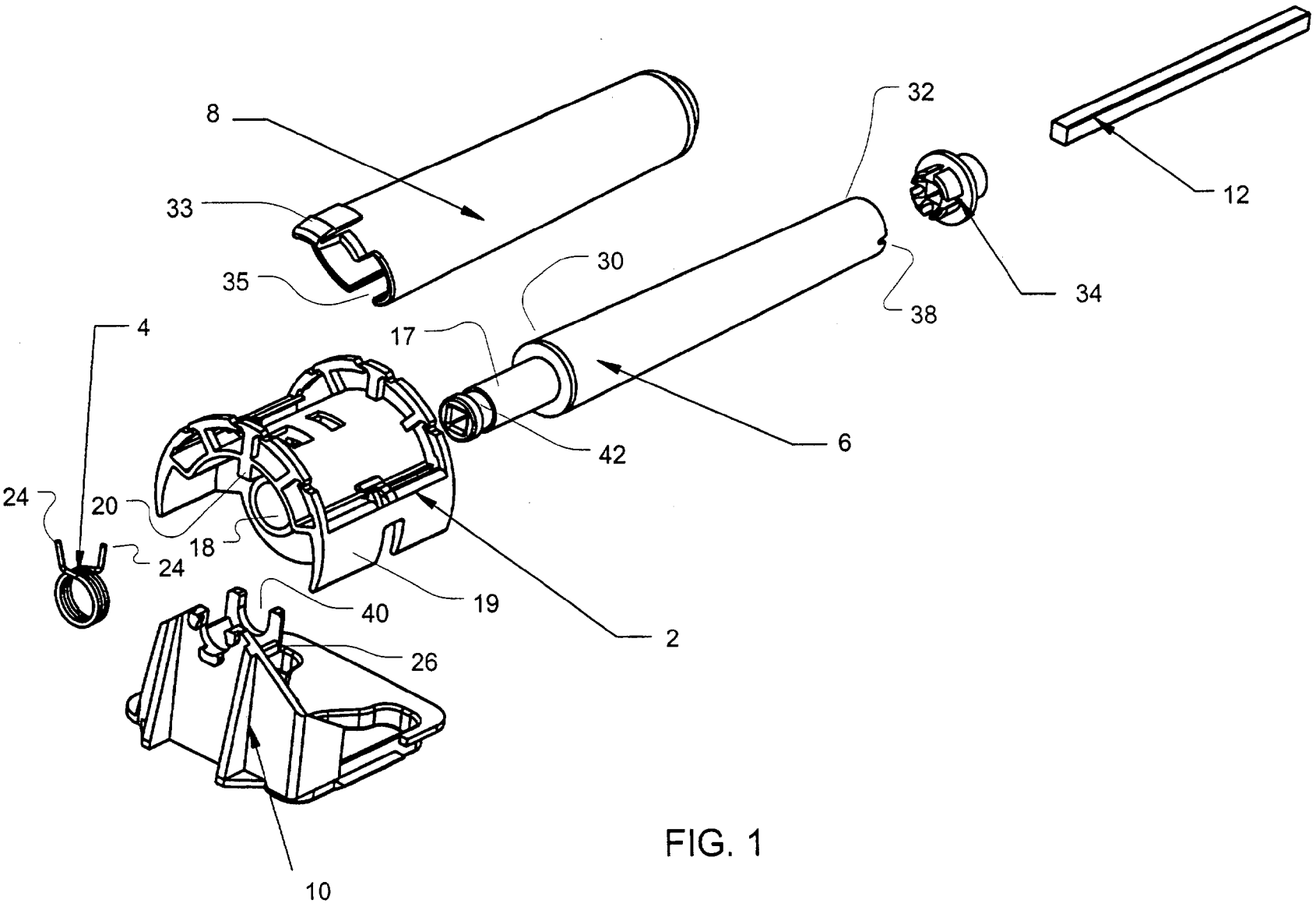
FIG. 1 is an exploded perspective view of the components of the invention.
Figure 2:
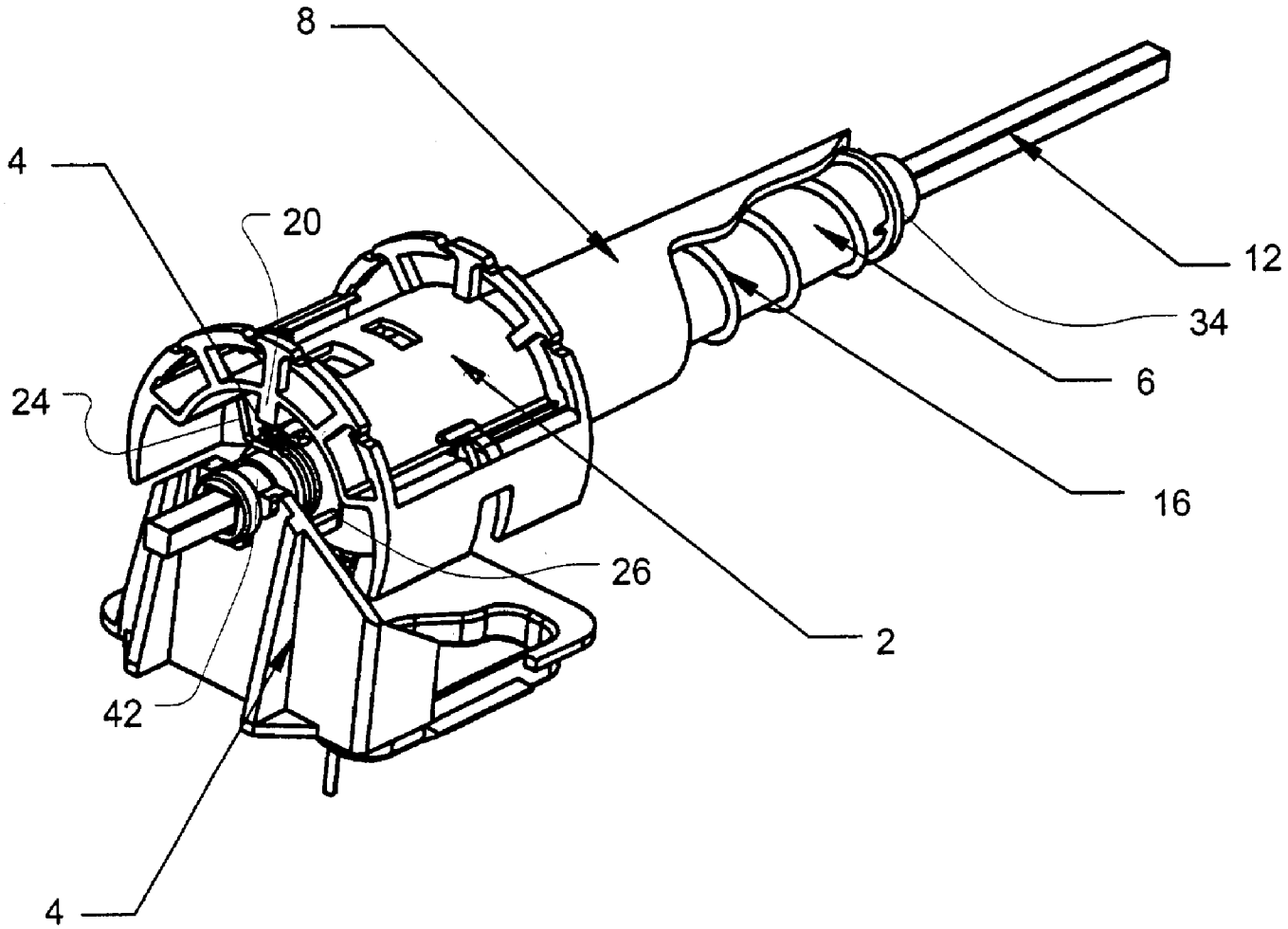
FIG. 2 is a partial cut away perspective view of the assembled components of the invention.
Figure 3:
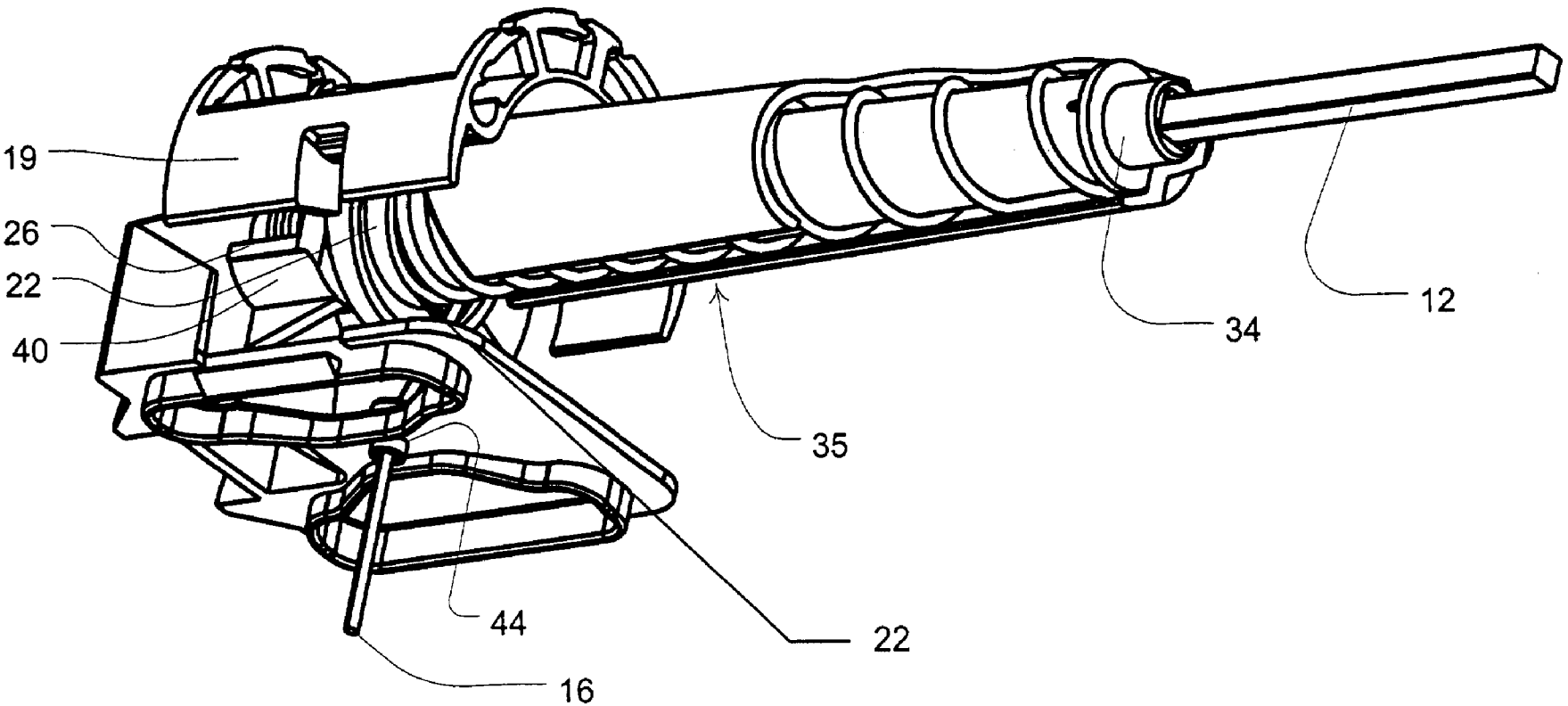
FIG. 3 is another partial cut away perspective view of the assembled components of the invention.
Figure 4:
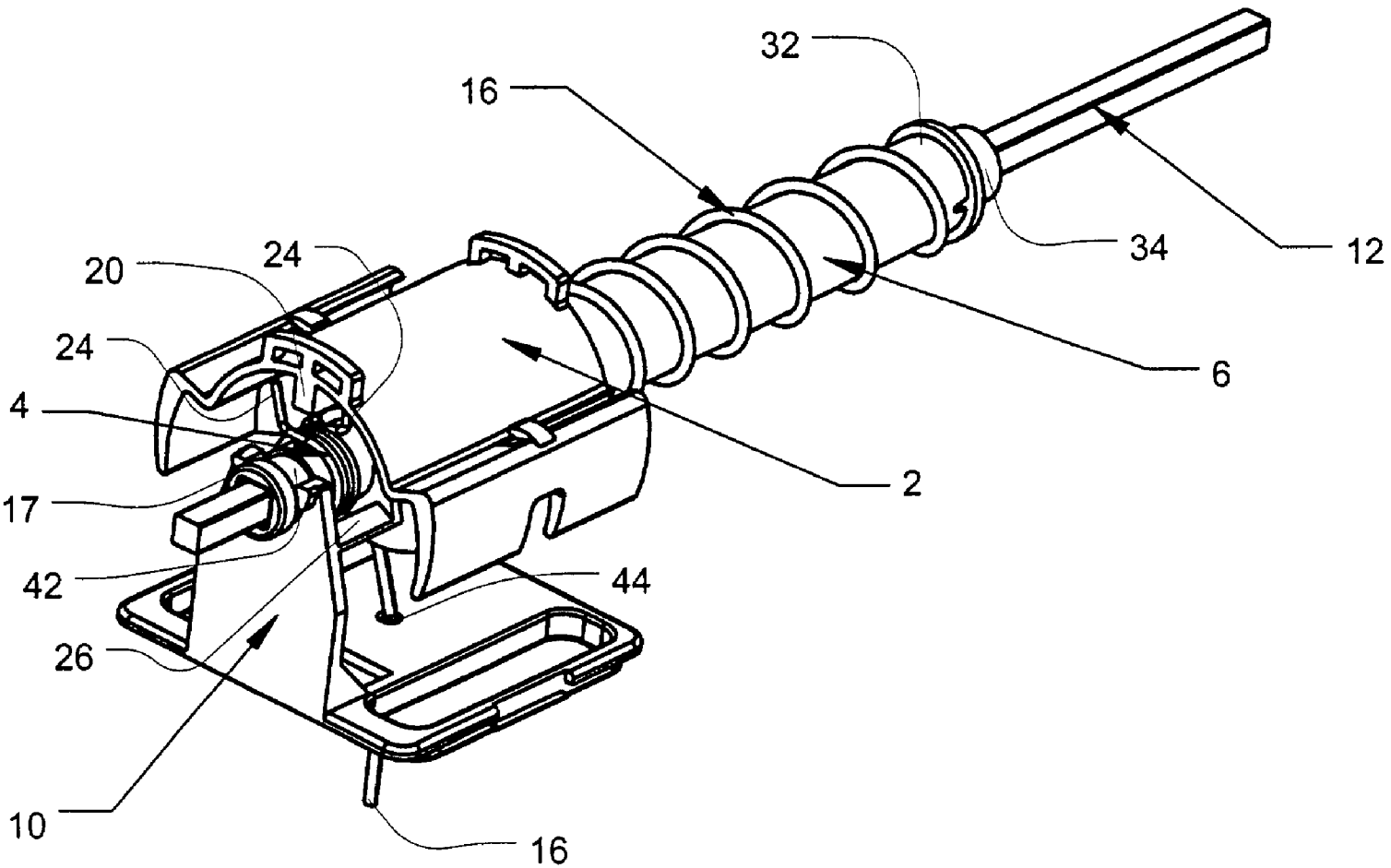
FIG. 4 is an alternative perspective view of some of assembled components of an alternative embodiment of the invention.

As illustrated in FIGS. 1–4, the invention includes a horizontal blind control that includes a tilting drum 2, torsion spring 4, cord-gathering shaft 6, cord cover 8 and support cradle 10. The components may be installed in a headrail H of a blind B. When combined with a turning shaft 12, a clutch 13 to rotate the shaft, a ladder cord 14 or ladder tape, a lifting cord 16, the components perform the dual functions of lifting the slats S of the blind B and/or tilting the slats S of the blind B to provide the desired level of shading or obstruction of light through a window on which the blind is installed. The preferred embodiment of each of the structures of the above components and a description of their operation are each addressed in turn.

Figure 8:
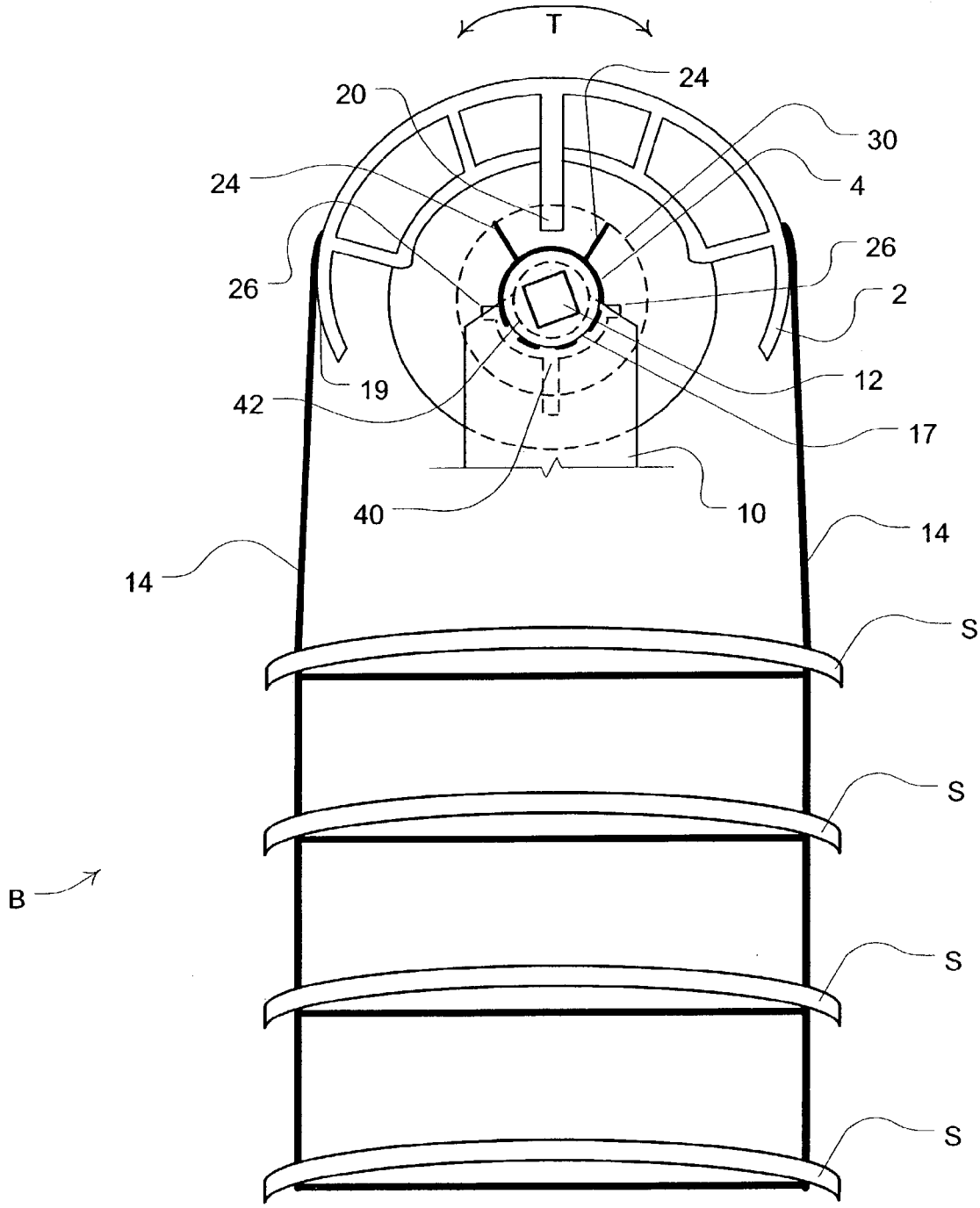
FIG. 8 is a side plan view of a tilting drum of the invention with ladder cord and slats of a blind.

The tilting drum 2 as the name implies is a component involved in achieving the function of tilting the slats S. The tilting drum 2 is configured to rest within the support cradle 10 when combined with the cord-gathering shaft 6 such that it can tilt in the directions illustrated by line T in FIG. 8. The tilting drum 2 receives an axle end 17 of the cord-gathering shaft 6 through a cylindrical orifice 18, about which, the tilting drum 2 can tilt. This tilting results in a proportionate raising and lowering of edges of the slats S on the ladder cord 14 when fixed to the tilting drum 2. In general, the exterior cylindrical surface 19 of the tilting drum 2 when fixed to the ladder cord provides a strong structure for supporting the ladder cord 14 when the drum bears the load of the slats S.

The tilting drum 2 has a two-sided drum key 20. The key 20 facilitates movement of the tilting drum 2 when either end of the torsion spring 4 rotates to apply a force against a side of the drum key 20. As such, the key 20 is fixed or integrated with the structure of the tilting drum 2. The key's structure also protrudes from the tilting drum 2 so that it may be positioned between the two ends of the torsion spring 4. The sides of the key 20 have sufficient surface area so as to ensure contact with either end of the torsion spring 4 upon movement of the torsion spring 4. The functioning of the key 20 in conjunction with the torsion spring 4 is described in more detail below.

The tilting drum 2 also has an angled surface 22 on one side of the drum. The surface is cylindrical ring truncated at an angle. The angled surface 22 encircles one portion of the cord-gathering shaft where the lifting cord 16 will coil. The angled surface 22 serves as a deflecting surface to move and align coils of the lifting cord 16 onto and across the cord-gathering shaft 6. The coils will align at an angle A (shown in FIGS. 6 and 7) equivalent to the angle of the angled surface 22. Since the tilting drum 2 will tilt partially forward or back with the rotation of the cord-gathering shaft 6, the angled surface 22 is preferably designed so that the angular deflection of the lifting cord 16 is relatively constant regardless of the movement of the tilting drum 2 on which the angled surface 22 is incorporated. The preferred embodiment of the angled surface 22 is an acute one such that the coils wind at an angle A less than 90 degrees relative to the central rotational axis of the cord-gathering shaft.

Figure 7:
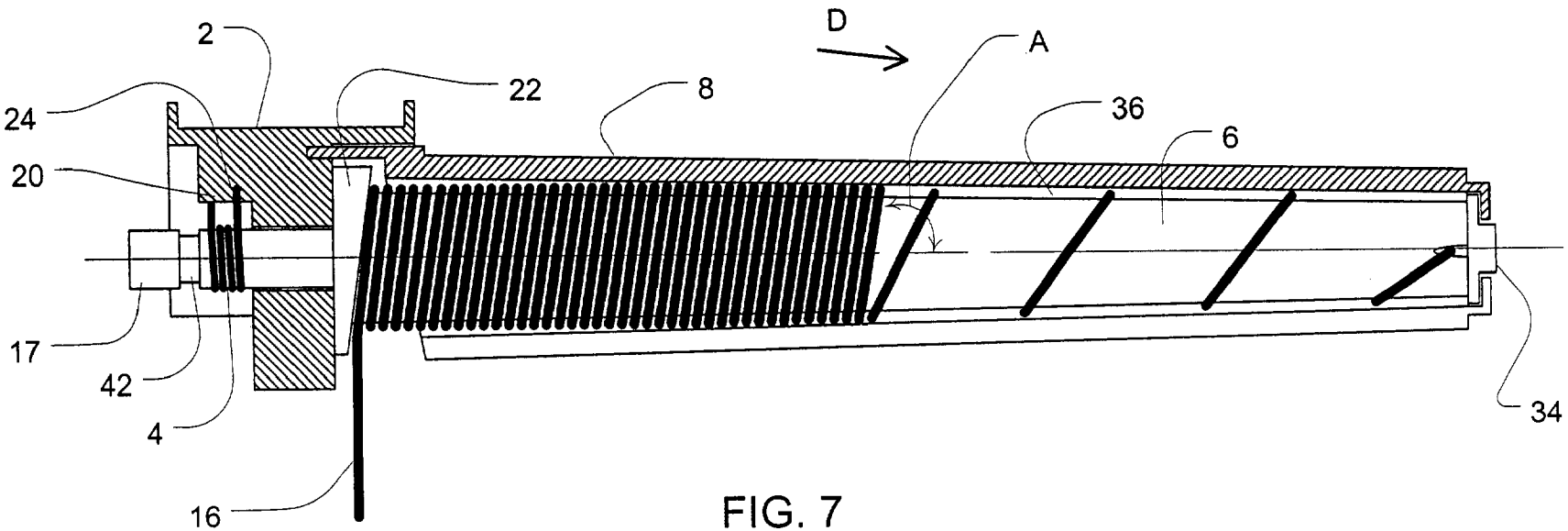
FIG. 7 is the side elevation partial section of the components of FIG. 6 with a lift cord.
Figure 7A:
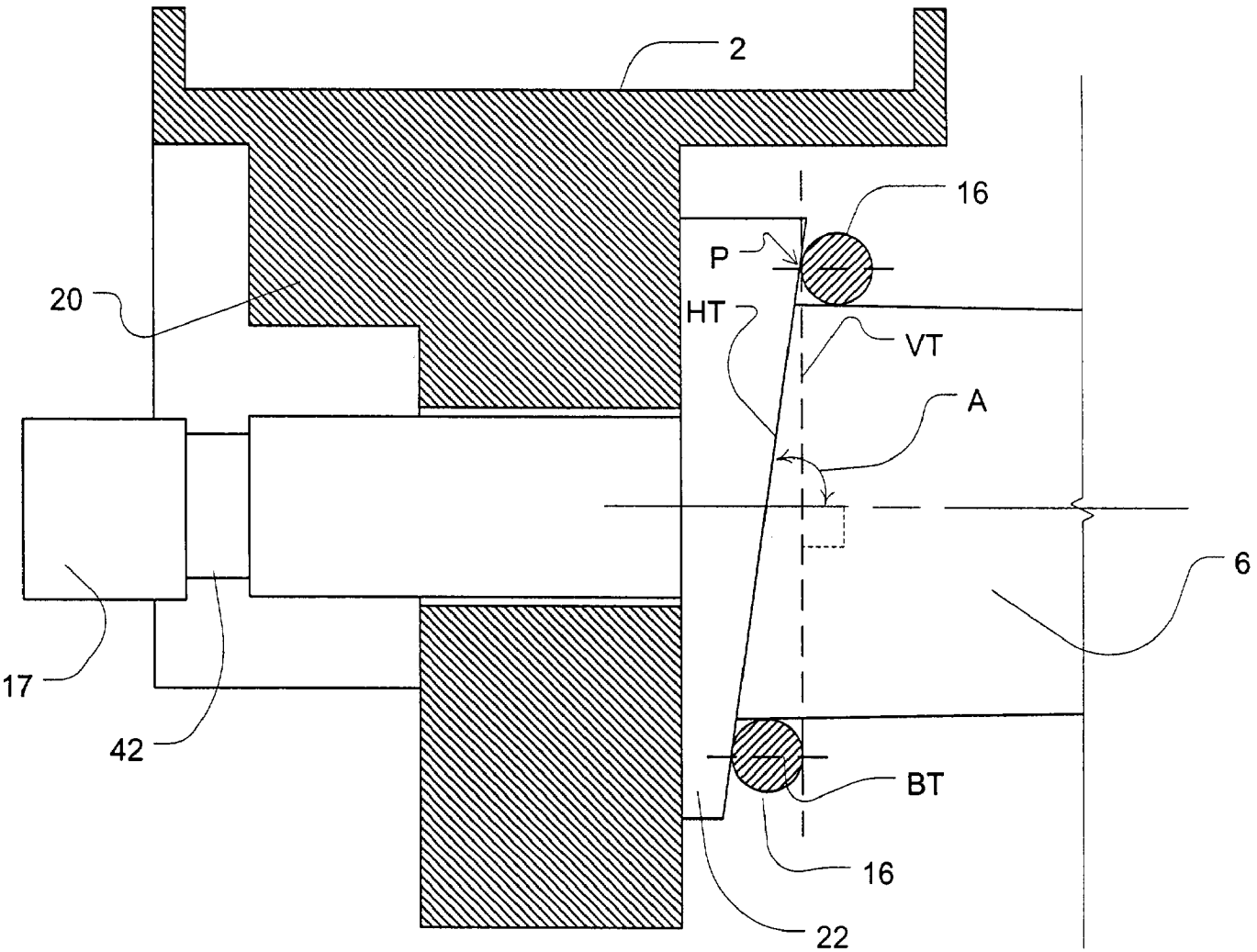
FIG. 7A is a partial side view of a preferred angled surface.

As illustrated in FIG. 7A, a preferred angle A of the angled surface 22 is derived by an imaginary right triangle with a base BT that is equivalent to the diameter of a portion of the lifting cord 16 on the surface of the cord-gathering shaft 6 and against the angled surface 22 and the vertical height VT of the length between the base BT and a point P where a second cord portion positioned on the cord-gathering shaft and against the angled surface opposite the first cord portion contacts the angled surface 22. A portion of the angled surface 22 then forms the hypotenuse HT of the imaginary right triangle. Preferred lifting cords typically include 0.9 mm, 1.2 mm and 1.2 mm in diameter but others may be utilized. The angled alignment of coils on the cone facilitates movement of the coils when deflected along the cone and when they are unwinding from the cone. Moreover, since the coils wind about the cone at an angle, fewer turns of the cone permit more lifting cord to wind when compared to the same number of turns with coils winding perpendicularly to the central rotational axis of the cone.

The torsion spring 4 is a spring of several turns. The spring's coils are formed around a diameter smaller than the diameter of the axle end 17 of the cord-gathering shaft 6 so that when the torsion spring 4 is at rest, its coils have a diameter smaller than the diameter of the axle end 17. Thus, when the torsion spring 4 is installed on the axle end 17, a force is stored in the torsion spring 4 that will create a frictional force against the axle end 17. This frictional force will cause the torsion spring 4 to rotate with the rotation of the axle end 17. Each end of the spring protrudes out from a center of the coils of the spring to form protruding spring ends 24. The spring ends 24 have a sufficient length to contact the drum key 20 and stops 26 on the support cradle 10. The stops 26 serve as a means for limiting the rotation of the torsion spring 4. When one of the spring ends 24 is rotationally forced against one of the stops 26, the torsion spring 4 will be forced to de-coil, thereby reducing the frictional force on the axle end 17, allowing the axle end 17 to turn within the torsion spring 4. When the force of the spring end against the stop ceases, the torsion spring 4 will re-coil to return the frictional force that coordinates movement of the torsion spring 4 with the axle end 17.

Figure 5:
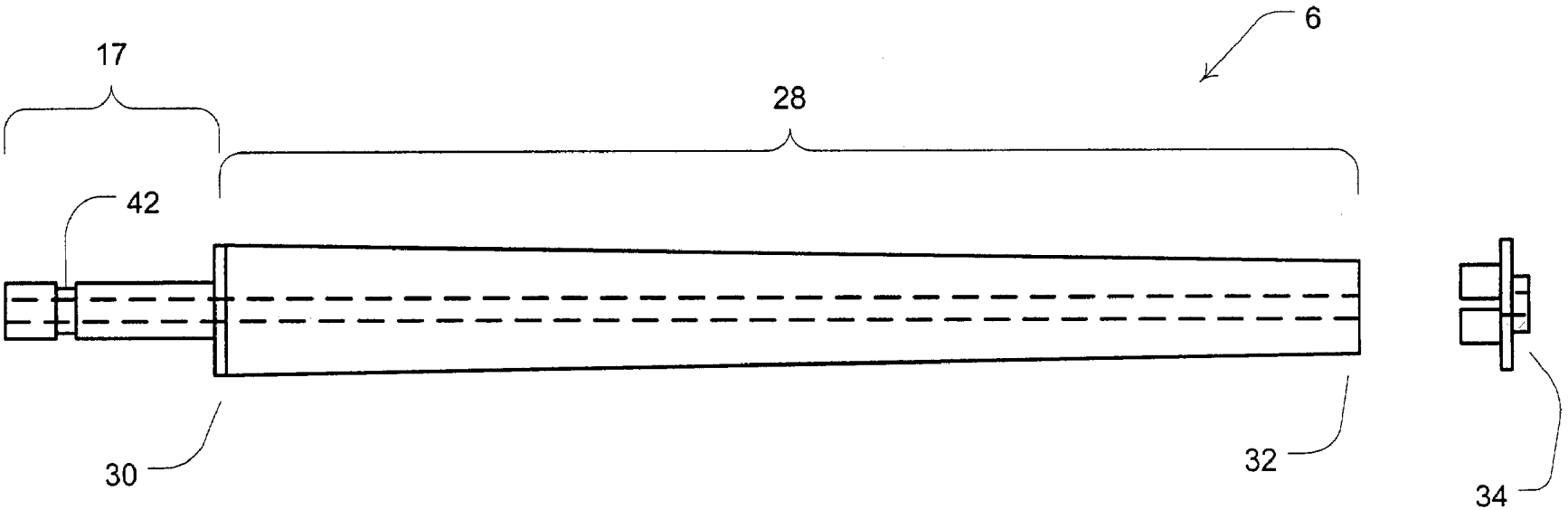
FIG. 5 is a plan view of the cord-gathering shaft of the invention.

As seen in the drawings and particularly FIG. 5, the cord-gathering shaft 6 provides a structure for gathering the lifting cord 16 in coils when the slats S are lifted. The cord-gathering shaft 6 preferably includes an integrated axle end 17 and truncated cone 28. An opening through the axle end 17 is keyed to receive the turning shaft 12 so that the cord-gathering shaft 6 rotates with the turning shaft 12. The truncated cone 28 is the surface on which the lifting cord 16 will wind in coils. The truncated cone 28 continuously and gradually slopes from larger diameter end 30 to a smaller diameter end 32. In a preferred embodiment, the larger diameter of the cone is approximately 0.625 inches and the smaller diameter is approximately 0.5 inches and the distance between these diameters is approximately 4.0 inches. However, the preferred slope is a one degree decline. This sloping is important because an insufficiently sloped cord-gathering shaft would impede lifting of the blind as a greater number of coils of the lifting cord gather about on a near cylindrical shaft. As discussed in more detail herein, the continuous slope provides the benefit of gradually relieving tension of the coils that wind onto the truncated cone 28 as they move from the larger diameter end 30, where they are first tightly formed, to the smaller diameter end 32, where they are loosely but orderly gathered.

For convenience, the cord-gathering shaft 6 also has an optional cord plug 34. The plug can serve the purpose of keeping the smaller diameter end 32 of the cord-gathering shaft 6 centered about the turning shaft 12. It also can provide a means for fixing the lifting cord to the cord-gathering shaft 6 so that the cord will coil about the cord-gathering shaft 6 when the turning shaft 12 is turned. A notch 38 in the truncated cone 28 allows the cord plug 34 to be installed on the cord-gathering shaft while the lifting cord 16 is fixed within. Other means for fixing the lifting cord to the cord-gathering shaft will be apparent to those skilled in the art.

Figure 6:
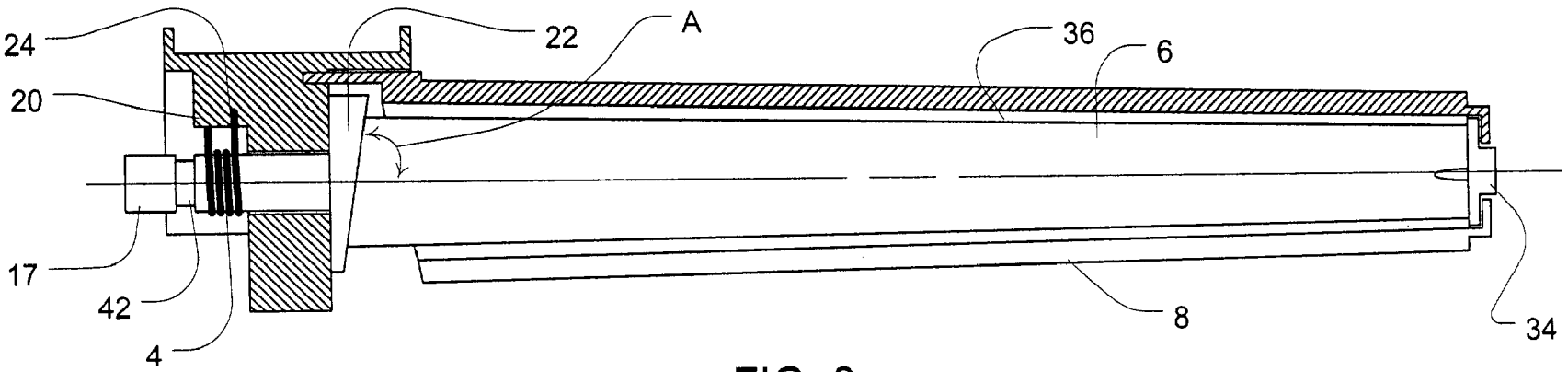
FIG. 6 is a side elevation of the cover, tilting drum, torsion spring and cord-gathering shaft with partial sectioning of the cover and tilting drum to depict the angled surface of the invention.

The ordered gathering of the lifting cord 16 onto the cord-gathering shaft 6 is assisted by the additional function of an optional cord cover 8. The cord cover 8 is a partial cylinder that may be removably attached to the cord-gathering shaft 8 by an insertion tab 33. A slot 35 along the surface of the cord cover 8 facilitates its removal. The internal surface of the cover 8 and external surface of the truncated cone 28 form a gap 36 as best illustrated in FIGS. 6 and 7. The distance across the gap 36 is larger than the diameter of the lifting cord 16 and preferably less than twice the diameter of the lifting cord 16. This allows loosened coils on the cord-gathering shaft 6 to traverse the surface of the truncated cone 28 as they are forced along the truncated cone 28 without tangling or jumping between adjacent coils of the lifting cord 16. As a result, the coils of the lifting cord 16 will generally have a diameter that is approximately equivalent to the changing diameter of the truncated cone 28 as the coils move from the larger diameter end 30 to the smaller diameter end 32. In this way, the cord cover 8 serves as a transverse guide for the lifting cord 18 as it gathers on and near the surface of the truncated cone 28.

The support cradle 10 serves as a rotational support for the tilting drum 2 and the cord-gathering shaft 6 in the headrail. It also serves to prevent the cord-gathering shaft 6 from any longitudinal movement within the headrail of the blind. The support cradle 10 has a brace 40 in which the axle end 17 of the cord-gathering shaft will rotate. A corresponding groove 42,in the axle end 17 of the cord-gathering shaft 6 fits within the brace 40. As previously noted, the support cradle 10 has stops 26 on both sides of the brace 40. Each of the stops 26 provide a limit position for the rotation of the torsion spring 4 in the brace 40 when one of the spring ends 24 rotates to a position against one of the stops 26. Additionally, the support cradle has a guide hole 44. The guide hole 44 is positioned on the support cradle 10 to guide or direct the lifting cord 16 to the face of the angled surface 22 of the tilting drum 2 when the tilting drum 2 is installed within the support cradle 10.

With the exception of the torsion spring 4 and the lifting and ladder cords or ladder tape, the components of the invention are preferably made from a durable plastic in an injection molding process. The torsion spring 4 preferably is made from music wire. These and other appropriate materials for constructing the invention will be recognized by those skilled in the art.

Figure 9:
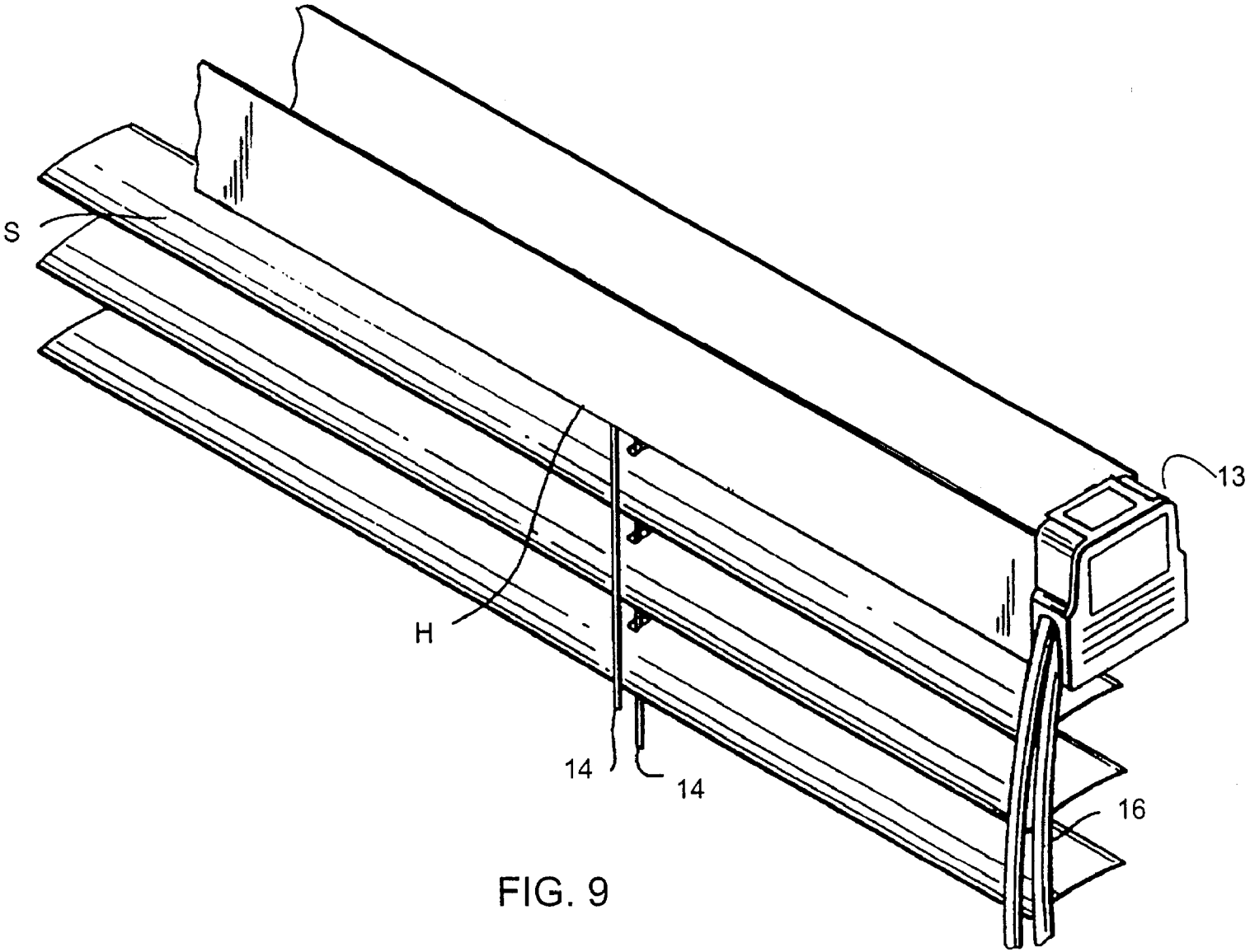
FIG. 9 is a perspective of a headrail of a horizontal window blind.

The operation of the combined components of the preferred embodiment of the invention will now be described. When a user pulls an optional control cord attached to a clutch 13 (shown in FIG. 9), the turning shaft 12 will begin to rotate in one direction. Other means for rotating the turning shaft 12 are known in the art also be combined with the invention such as a motor. This rotation of the turning shaft 12 also rotates the cord-gathering shaft 6 and its axle end 17. As the axle end 17 rotates, the torsion spring 4 will also rotate. When one of the spring ends 24 presses against a drum key 20, the tilting drum 2 will rotate with the torsion spring 4 and the cord-gathering shaft 6 in the support cradle 10. This will in turn cause the slats S to tilt in a corresponding direction as one side of the ladder cord 14 or ladder tape is raised and the opposing side lowered due to the rotation of the tilting drum 4 since the ladder cord 14 is fixed to the tilting drum 4.

However, when the other of the spring ends 24 contacts one of the stops 26 on the support cradle 10, the spring will de-coil, thus reducing the frictional force on the cord-gathering shaft. As a result, the cord-gathering shaft 6 will continue to rotate but the torsion spring 4 and tilting drum 2 will rotate no further. Consequently, no further tilt of the slats S will result with the continued rotation of the turning shaft 12 in the same direction. In this way, a partial rotation of the turning shaft 12 can serve to tilt the slats S.

Since the lifting cord 16 is fixed to one end of the cord-gathering shaft 6, the initial and continued rotation of the turning shaft 12 will cause the winding of the lifting cord 16 onto the conic surface 28 of the cord-gathering shaft. Since the lifting cord 16 passes through the guide hole 44 in the support cradle 10, the lifting cord will begin to coil tightly near the larger diameter 30 of the conic surface 28 against the angled surface 22. During winding, these tight coils near the angled surface 22 will provide a frictional contact around the cord-gathering shaft 6. This frictional contact will bear the load of the slats S and with continued turning of the cord-gathering shaft 6 will raise the slats S.

During continued raising, as illustrated in FIG. 7, previously wound coils of the lifting cord 16 will move across the cord-gathering shaft 6 in the direction D of the smaller diameter 32 of the conic surface 28 as they are deflected away from the angled surface 22 of the tilting drum 2 from the insertion of newly formed coils between the angled surface and the previously wound coils of the lifting cord 16.

Depending on the force of the load being lifted by the cord, as the wound coils are deflected away from the tilting drum 2, the coils further away from the angled surface 22 will cease to provide significant frictional contact with the cord-gathering shaft 6 as the diameter of the cord-gathering shaft 6 gradually reduces. By gradually reducing the frictional hold of coils further from the angled surface 22, the required deflection force necessary to move or slide all of the wound coils along the cord-gathering drum is decreased. This decrease also reduces the force necessary to turn the turning shaft 12. Despite the loosening coils, the cord cover 6 maintains the coiled portions of the lifting cord in a neat, easily unwindable fashion by guiding them to have coiled diameters that are comparable to the varying diameters of the cord-gathering shaft 6. Absent a definitive change in diameters of the cone, the cord would become difficult to wind as it gathers on the cone.

In a similar manner, when the user pulls the control cord rotating the turning shaft 12 in the opposite direction, the torsion spring 4 will tighten on that axle end 17 of the cord-gathering shaft 6. As the torsion spring rotates the other of the spring ends 24 will push on the opposite side of the drum key 20, which will also rotate in the same direction, causing the slats S to tilt in the other direction. The rotation of the tilting drum 2 and the tilting of the slats S will stop when the other of the spring ends 24 contacts the stop 26 of the support cradle 10. If the user continues to rotate the cord-gathering shaft, the rotation will unwind the lifting cord 16 without further tilting the slats S.

The above-described invention provides many advantages over the prior art that would be recognized by those skilled in the art. Since the weight of the blind is suspended from the rigid arms of the tilting drum, and not flexible tilter arms. Tilting is advantageously achieved by an independent torsion spring. Thus, the weight of the blind does not have a great influence on tilting capability. The particular structure permits the apparatus to be installed closely to the edges of the blind, which has advantages in fabrication of vinyl slot blinds and foe-wood blinds. Furthermore, the manufacture of the components is simpler than other prior art devices. The assembly of the unit is not direction dependent, which has big advantages in narrow blinds fabrication.

Figure 10:
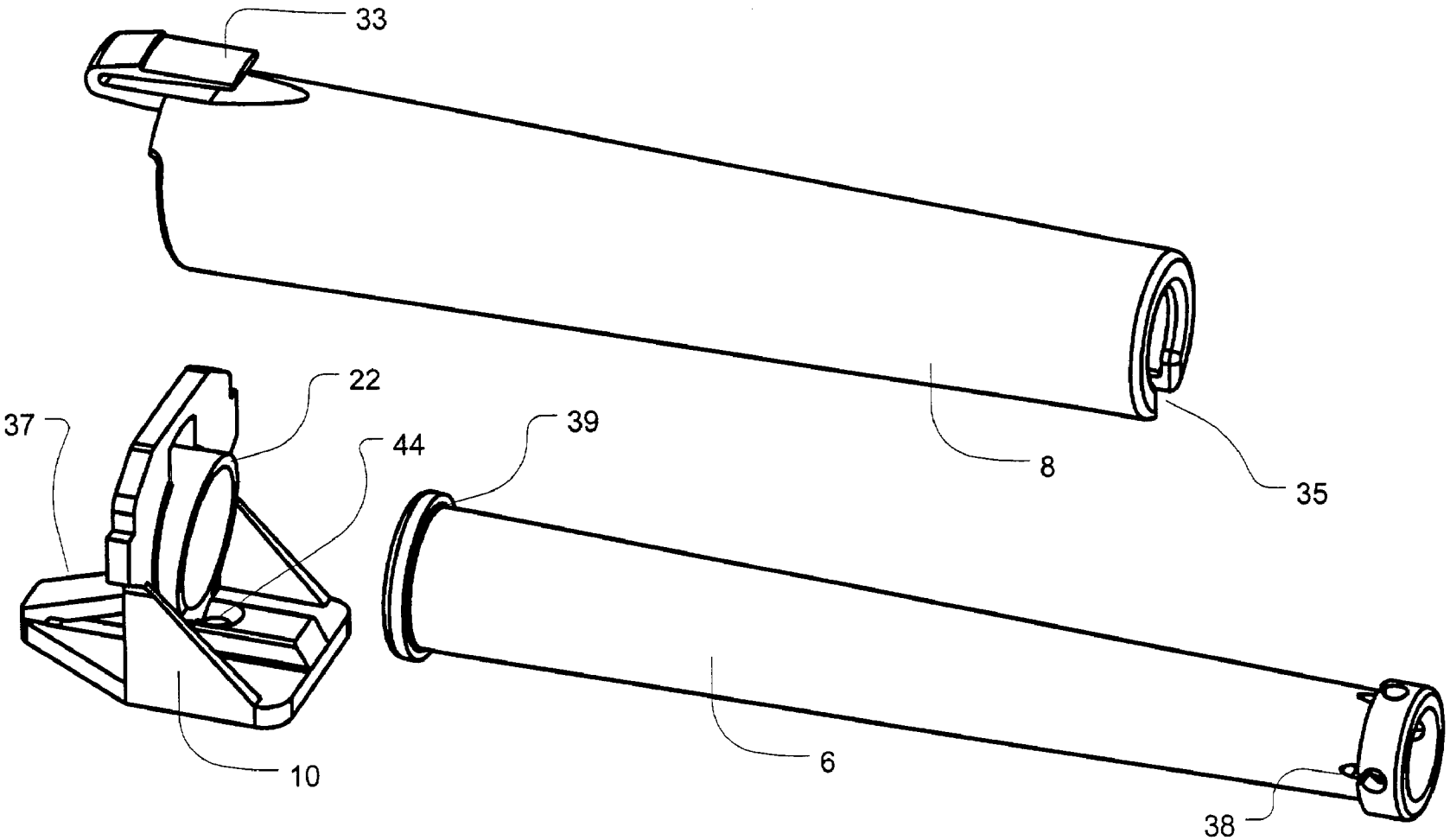
FIG. 10 is a perspective view of some components of an embodiment of the invention without features for tilting a blind.
Figure 11:
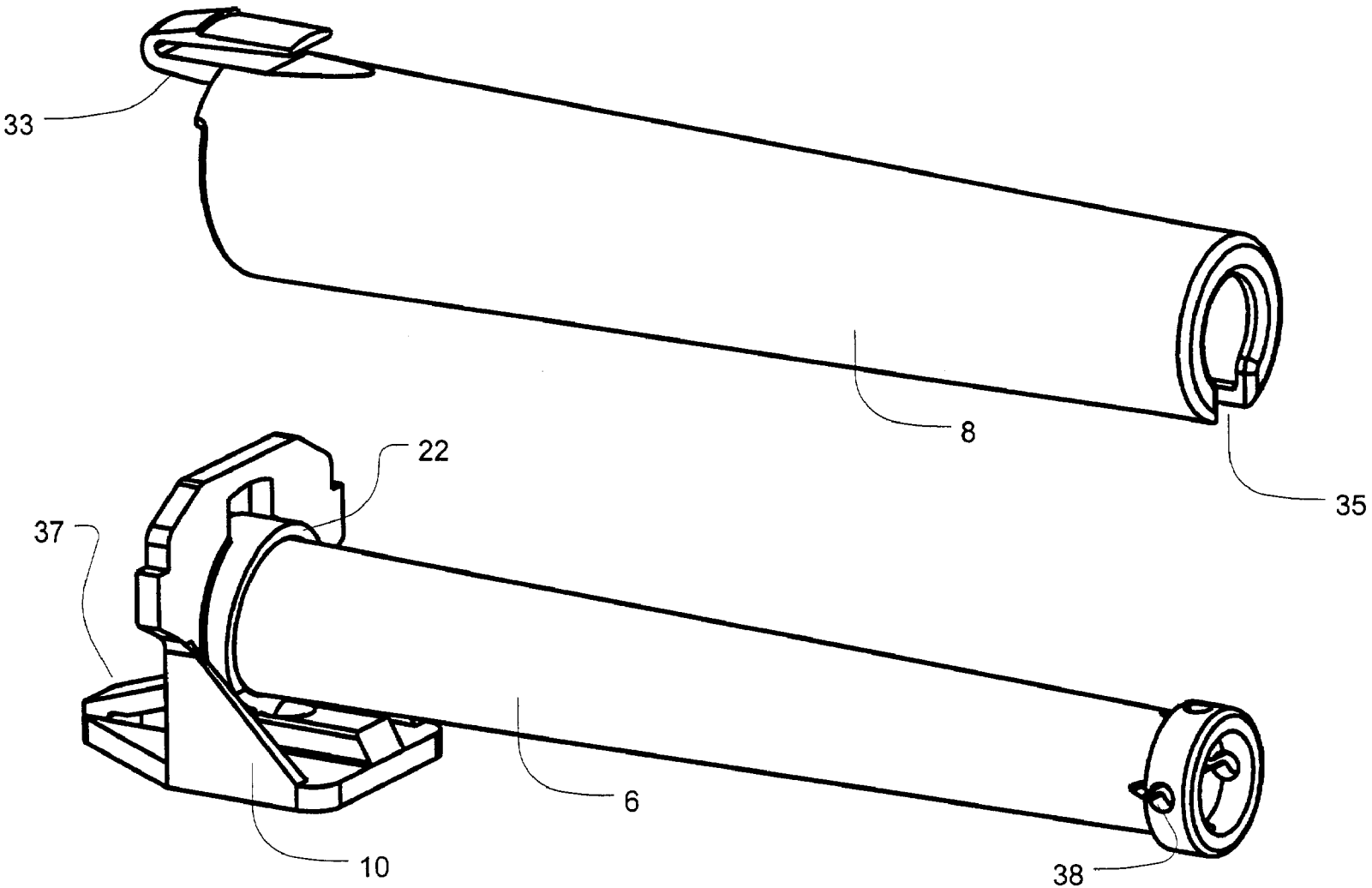
FIG. 11 is a perspective view of the embodiment of FIG. 10 partially assembled.
Figure 12:
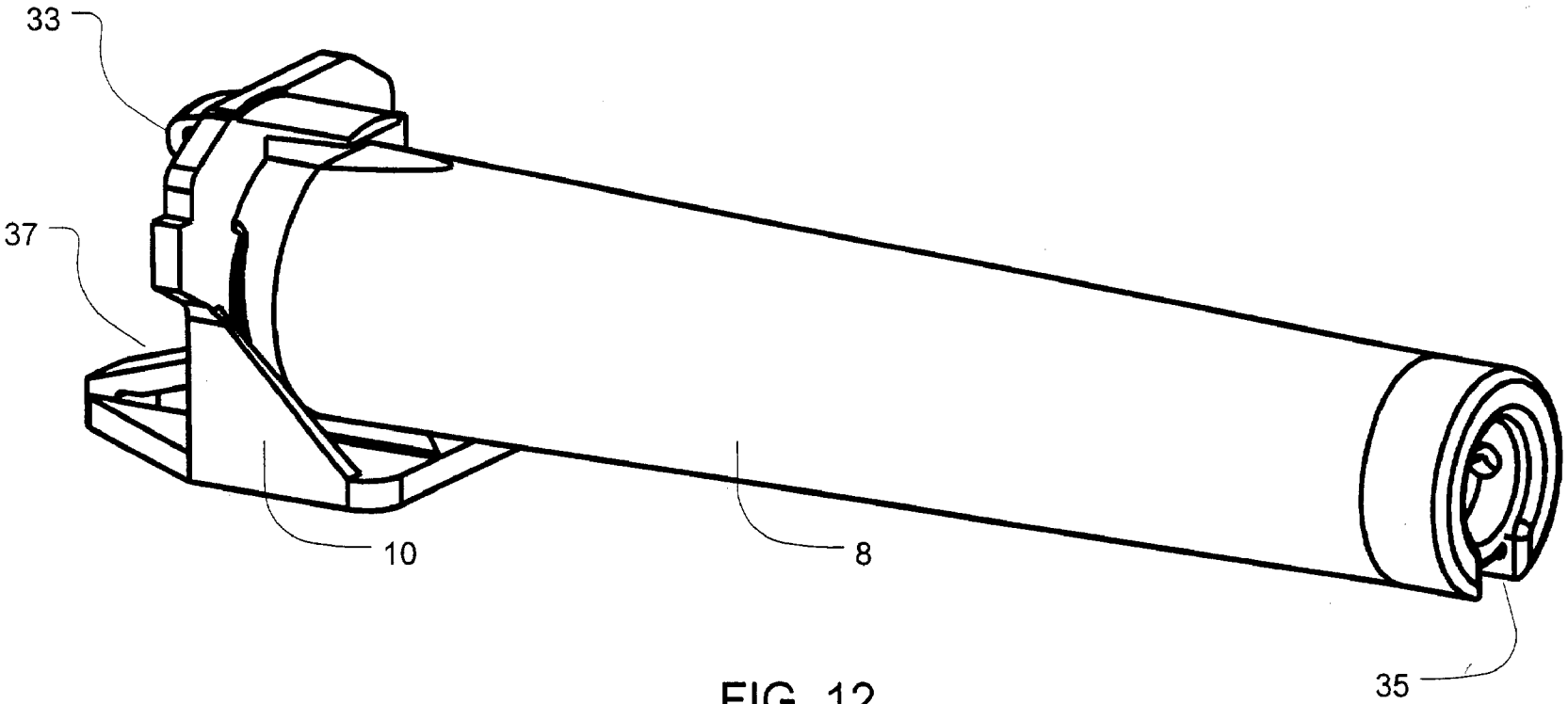
FIG. 12 is a perspective view of the embodiment of FIG. 10 completely assembled.

While the invention has been described with regard to a particular embodiment, it is to be understood that the features are merely illustrative of the principles of the invention. Those skilled in the art would understand that other variations can be made without departing with the spirit and scope of the invention as defined by the claims. For example, one skilled in the art would recognize that some of the components or portions thereof associated with the lifting function may be utilized independently from other components associated with the tilting function and vice versa. For example, FIG. 10 and FIG. 11 depict a lifting device without corresponding structure to perform tilting of any attached slats. In this embodiment, the support cradle 10 has an angled surface 22 fixed to it rather than a tilting drum. In this embodiment, since the support cradle 10 does not move with the rotation of the cord-gathering shaft 6, the angled surface 22 does not rotate.

The invention claimed is:

1. An apparatus to control the lift and tilt of slats of a horizontal blind comprising:

a truncated cone fixable with a lifting cord to facilitate coiling of the lifting cord on the cone when the cone is rotated about a shaft, wherein the cone has a first end with a first diameter and a second end with a second diameter;

an axle portion joined with the cone so that the axle portion rotates with the cone;

a torsion spring frictionally wrapped about the axle portion, wherein the torsion spring has protruding ends;

a tilting drum fixable with a ladder cord to raise and lower alternate sides of the ladder cord wherein the tilting drum rotates on the axle portion and has a drum key positioned between the protruding ends of the torsion spring, and wherein the tilting drum has a deflecting surface positioned at the first end to direct a coiling portion of the lifting cord onto the first end of the cone and to move previously wound coils across the cone towards the second diameter;

a support with a brace to prevent longitudinal movement of the axle portion and to permit rotation of the axle portion, wherein the support further comprises a limit means to limit the rotation of the torsion spring; and a guide to lead the lifting cord to the deflecting surface.

2. The apparatus of claim 1 further comprising a cover to guide coils traversing from said first end to said second end.

3. The apparatus of claim 2 wherein the cover and the cone form a gap between a surface of cone and a surface of the cover, wherein a distance across the gap is less than two times the diameter of the lifting cord.

4. The apparatus of claim 3 wherein the deflecting surface is at an angle relative to an imaginary axis through a diameter of the cone so that the coils of the lifting cord wind about the cone approximately parallel to the angle.

5. An apparatus to control the movement of slats of a horizontal blind comprising:

a cord-gathering shaft comprising a rotatable shaft with a surface to receive a lifting cord in a plurality of coils around the surface of the shaft, the surface having a first end with a first diameter, a second end with a second diameter and a length between the first end and the second end;

an angled surface encompassing a portion of the first end of the surface of the shaft to deflect coils of a lifting cord to move at an angle across the length of the surface of the shaft, the angle being substantially that of the angle of the angled surface, and the angle being less than 90 degrees relative to a central axis of rotation of the cord-gathering shaft;

means for fixing a lifting cord to the cord-gathering shaft near said second end;

guide means to direct a lifting cord at the angled surface near the first end; and a lifting cord wound thereon wherein the angled surface forms the hypotenuse of an imaginary right triangle (a) with a base of the length of a diameter of a first cord portion positioned on the cord-gathering shaft and against the angled surface and (b) with a height of the length between the base and a point where a second cord portion positioned on the cord-gathering shaft and against the angled surface opposite the first cord portion contacts the angled surface.

6. The apparatus of claim 5 wherein the angled surface rotates.

7. The apparatus of claim 5 further comprising a cover means to guide coils traversing from said first end to said second end.

8. The apparatus of claim 7 wherein the surface of the shaft is a truncated cone.

9. The apparatus of claim 8 further comprising means for tilting slats of the blind in conjunction with a part of the rotation of the cord-gathering shaft.

10. An apparatus to control the movement of slats of a horizontal blind comprising:

a cord-gathering shaft comprising a rotatable shaft with a surface to receive a lifting cord in a plurality of coils around the surface of the shaft, the surface having a first end with a first diameter, a second end with a second diameter and a length between the first end and the second end;

a rotating angled surface encompassing a portion of the first end of the surface of the shaft to deflect coils of a lifting cord to move at an angle across the length of the surface of the shaft, the angle being substantially that of the angle of the angled surface, and the angle being less than 90 degrees relative to a central axis of rotation of the cord-gathering shaft;

means for fixing a lifting cord to the cord-gathering shaft near said second end;

guide means to direct a lifting cord at the angled surface near the first end;

cover means to guide coils traversing from said first end to said second end;

wherein the shaft continuously and gradually decreases in diameter beginning with the first diameter and ending at the second diameter.

11. The apparatus of claim 10, wherein the surface of the shaft is a truncated cone.

12. The apparatus of claim 11, further comprising means for tilting slats of the blind in conjunction with a part of the rotation of the cord-gathering shaft.

13. An apparatus to control the lift and tilt of slats of a horizontal blind comprising:

a cord-gathering shaft to gather and wind coils of a lifting cord consisting of a cone that continuously and gradually decreases in diameter beginning with a first diameter and ending at a second diameter;

a deflecting surface at the first end of the cone to move gathered coils of a lifting cord from the first diameter to the second diameter;

guide means for directing a lifting cord to the deflecting surface;

means for rotating the cord-gathering shaft;

means for fixing a lifting cord to the cord-gathering shaft; and means for tilting slats of the blind.

14. The apparatus of claim 13 further comprising a cover means to guide coils traversing from said first end to said second end.

15. The apparatus of claim 14 wherein the deflecting surface rotates.

16. A horizontal window shade comprising:

a headrail to contain controls for adjustment of a window blind;

a lifting cord;

a ladder cord or ladder tape;

a plurality of slats attached with the lifting cord and the ladder cord to permit said slats to lift and tilt with the movement of the lifting cord and the ladder cord;

a turning shaft;

a means for rotating the shaft;

a cord-gathering shaft to wind the lifting cord and configured to receive and rotate in conjunction with the turning shaft, the cord-gathering shaft comprising (a) a truncated cone having a conic surface beginning with a first diameter and continuously and gradually decreasing in diameter to end at a smaller diameter, and (b) an axle end;

a torsion spring frictionally wrapped about the axle end, wherein the torsion spring has protruding ends;

a tilting drum to raise and lower alternate sides of the ladder cord, said tilting drum having an opening to receive the axle end of the cord-gathering shaft and rotate thereon, said tilting drum comprising (a) surface portions to fix a ladder cord, (b) a drum key positioned to be between the protruding ends of the torsion spring, and (c) an angled surface to deflect a lifting cord onto the truncated cone at an angle; and a support cradle for attachment to a headrail of a window blind, the support cradle comprising (a) a brace for rotational support of the axle end of the cord-gathering shaft, (b) a set of stops positioned to limit the rotation of the torsion spring and (c) a cord guide positioned to direct a lifting cord at the angled surface of the tilting drum.

17. The device of claim 16 further comprising a cover over the truncated cone to guide coils of a lifting cord traversing along the truncated cone between the first diameter and the smaller diameter.

18. The device of claim 17 wherein the cover and the truncated cone form a gap less than approximately double the width of a diameter of a lifting cord.

19. The device of claim 18 wherein said cover comprises a slot and said cover is fixably removable from the cord-gathering shaft.

20. The device of claim 19 wherein the angled surface comprises a surface that rotates with the tilting drum.

21. The device of claim 20 wherein said angle is less than 90 degrees relative to an axis of rotation of the cord-gathering shaft.

22. An apparatus to control the movement of slats of a horizontal blind comprising:

a cord-gathering shaft comprising a rotatable shaft with a surface to receive a lifting cord in a plurality of coils around the surface of the shaft, the surface having a first end with a first diameter, a second end with a second diameter and a length between the first end and the second end;

an angled surface encompassing a portion of the first end of the surface of the shaft to deflect coils of a lifting cord to move at an angle across the length of the surface of the shaft;

means for fixing a lifting cord to the cord-gathering shaft near said second end;

guide means to direct a lifting cord at the angled surface near the first end; and a cover means to guide coils traversing from said first end to said second end;

wherein the shaft continuously and gradually decreases in diameter beginning with the first diameter and ending at the second diameter.

23. The apparatus of claim 22 wherein the surface of the shaft is a truncated cone.

24. The apparatus of claim 23 further comprising means for tilting slats of the blind in conjunction with a part of the rotation of the cord-gathering shaft.

25. The apparatus of claim 22 wherein the angled surface rotates.

26. The apparatus of claim 22 further comprising a lifting cord wound thereon wherein the angled surface forms the hypotenuse of an imaginary right triangle (a) with a base of the length of a diameter of a first cord portion positioned on the cord-gathering shaft and against the angled surface and (b) with a height of the length between the base and a point where a second cord portion positioned on the cord-gathering shaft and against the angled surface opposite the first cord portion contacts the angled surface.

* * * * *